US012607423B2

(12) United States Patent
Ferrell

(10) Patent No.: US 12,607,423 B2
(45) Date of Patent: Apr. 21, 2026

(54) TWO PART BEDDING BLOCK FOR A FIREARM

(71) Applicant: Manners Composite Stocks LLC, North Kansas City, MO (US)

(72) Inventor: Timothy John Ferrell, Sturgis, SD (US)

(73) Assignee: Manners Composite Stocks, LLC, North Kansas City, MO (US)

( * ) Notice: Subject to any disclaimer, the term of this patent is extended or adjusted under 35 U.S.C. 154(b) by 0 days.

(21) Appl. No.: 19/032,441

(22) Filed: Jan. 21, 2025

(65) Prior Publication Data

US 2025/0237446 A1 Jul. 24, 2025

Related U.S. Application Data

(60) Provisional application No. 63/622,405, filed on Jan. 18, 2024.

(51) Int. Cl.
*F41A 3/06* (2006.01)
*F41A 3/66* (2006.01)

(52) U.S. Cl.
CPC ..... *F41A 3/66* (2013.01)

(58) Field of Classification Search
CPC ..... F41A 3/64
See application file for complete search history.

(56) References Cited

U.S. PATENT DOCUMENTS 512,434 A * 1/1894 Davenport ..... F41A 21/482 42/23
2,290,778 A * 7/1942 Swebilius ..... F41A 11/00 42/75.01
2,867,931 A * 1/1959 Schreiber ..... F41A 21/485 42/75.01
2,967,368 A * 1/1961 Williams ..... F41A 21/482 42/75.01
3,060,612 A * 10/1962 Brown ..... F41A 21/48 42/75.01
3,183,617 A * 5/1965 Ruger ..... F41A 21/484 42/25
3,206,885 A * 9/1965 Dye ..... F41C 23/00 42/75.03
3,439,441 A * 4/1969 Lawley ..... F41C 23/00 42/75.01
3,711,983 A * 1/1973 Allyn ..... F41A 19/32 42/75.03
4,057,924 A * 11/1977 Joseph ..... F41A 21/48 42/75.01
4,312,146 A * 1/1982 Koon, Jr. ..... F41C 23/00 42/75.03
6,487,805 B1 * 12/2002 Reynolds ..... F41A 21/485 42/75.03

(Continued)

*Primary Examiner* — Derrick R Morgan
(74) *Attorney, Agent, or Firm* — Mark A. Pitchfod; Eric B. Fugett; Pitchford Fugett, PLLC

(57) ABSTRACT

A firearm including a rear action screw pillar configured to mount in a stock of the firearm and receive a rear action screw therethrough to secure an action of the firearm to the rear action pillar. The firearm further includes a front action screw pillar configured to mount in the stock of the firearm forward of the rear action screw pillar and receive a front action screw therethrough to secure the action of the firearm to the front action screw pillar.

20 Claims, 6 Drawing Sheets

(56) References Cited

U.S. PATENT DOCUMENTS

| | | | | |
|---|---|---|---|---|
| 7,726,060 | B1 * | 6/2010 | Jones | F41C 23/00 42/75.02 |
| 7,841,119 | B1 * | 11/2010 | Boyd | F41C 23/16 42/71.01 |
| 7,886,473 | B2 * | 2/2011 | Rotharmel | F41A 3/66 42/75.03 |
| 8,881,444 | B2 * | 11/2014 | Warburton | F41C 23/06 42/74 |
| 9,625,224 | B2 * | 4/2017 | Olsen | F41A 3/66 |
| 9,726,444 | B1 * | 8/2017 | Sisk | F41A 3/66 |
| 10,859,342 | B2 * | 12/2020 | Ludlow | F41C 23/16 |
| 10,955,205 | B2 * | 3/2021 | Bitz | F41A 3/66 |
| 11,248,861 | B2 * | 2/2022 | Lukic | F41A 11/00 |
| 2012/0204465 | A1 * | 8/2012 | Hasler | F41A 3/64 42/75.03 |
| 2017/0299297 | A1 * | 10/2017 | Scalf | F41A 11/02 |
| 2017/0314890 | A1 * | 11/2017 | Ludlow | F41A 21/48 |
| 2022/0412679 | A1 * | 12/2022 | Rosset | F41A 3/66 |
| 2023/0046241 | A1 * | 2/2023 | Allan | F41C 23/18 |

* cited by examiner

TWO PART BEDDING BLOCK FOR A FIREARM

CROSS-REFERENCE TO RELATED APPLICATIONS

This application claims priority to and hereby incorporated by reference in its entirety U.S. Provisional Patent Application Ser. No. 63/622,405 entitled "TWO PART BEDDING BLOCK FOR A FIREARM" filed on Jan. 18, 2024.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present disclosure relates generally to firearms. More particularly, the present disclosure relates to an apparatus and method for mounting a barreled action for a rifle to a stock or chassis.

A conventional rifle generally comprises groups of components, each one typically consisting of several additional subcomponents. These groups may include the bolt assembly, the barreled action, the trigger group, and the stock. The stock provides a shooter a convenient member by which the rifle is typically carried and braced against a part of the shooter's body. A rifle stock typically has a rear shoulder support portion designed to be held against a shooter's shoulder during firing (i.e., the buttstock or butt), and a forward forearm support portion, that includes an appropriate recess or recesses, shaped and formed to receive, support, and carry the barreled action of the rifle (i.e., the forend).

Stability and maintenance of a precise action-to-stock fit is essential to accuracy of the rifle because a poor fit between the action and stock encourages movement of the action inside the stock during firing that can adversely affect projectile trajectory and thus accuracy and precision of shot placement over time. Similarly, when the action bolts or screws of a rifle are suffering from an imperfect fit between the rifle's action and stock and the action bolts or screws are tightened, strain and stress placed on the action can cause an undesirable decrease in accuracy and precision.

Various methods and devices have been utilized to rigidly and stably bed or fit rifle actions and the attached barrels into a stock. One well known method involves the use of an epoxy composition, or other bedding material, to precisely secure or "bed" the action to the stock. However, this bedding method typically requires the services of a gunsmith, and the stock and action are permanently married to one another. Thus, the stock is limited to one cartridge and magazine configuration. If a shooter desires to utilize a different barreled action, such as one for a different caliber cartridge or a barreled action from a different manufacturer, an entirely different stock must be fitted to that action.

Another option for mounting or fitting a barreled action of a rifle to a rifle stock or chassis involves the use of an intermediate member known as a bedding block. A bedding block is a block of aluminum mounted or bedded within a stock and configured to receive the action bolts or screws therethrough to secure the action to the block and thus the stock.

In some applications, weight is very important. For example, in high elevation hunting (e.g., Elk hunting), hunters must travel (i.e., hike) long distances over the course of multiple days. Therefore, minimizing the weight of the firearm is beneficial to the ability of the shooter to cover large distances. These shooters will go to extreme lengths to decrease the weight of gear that they must carry on these outings. Every aspect of the shooter's gear becomes weight sensitive. For example, the shooter may select an optic with weight as a primary consideration, choose an action with weight as a primary consideration (e.g., going to a reduced barrel length to minimize weight), choose a stock based on weight, choose clothing based on weight, etc. Current small chassis firearms (i.e., lightweight firearms), such as the Manner's Composite Stocks M5 Mini chassis includes a one piece aluminum bedding block weighing approximately 6 ounces.

SUMMARY OF THE INVENTION

Aspects of the disclosure relate to an ultra-lightweight 2-piece bedding block system for a composite or wood stock of a firearm, which eliminates the need for a gunsmith to install traditional pillars and an epoxy bedding system.

In one aspect, a bedding block for a firearm includes a front part and a rear part. Each of the front part and the rear part incorporates an outside dimension that locks the bedding block into the stock, once installed (e.g., epoxied) into the stock. Once installed in a composite or wood stock, the stock has a strong lightweight bedding system that the end consumer can use to install an action into the stock, without the need for a more traditional pillar and epoxy bedding system.

In another aspect, a firearm includes a rear action screw pillar configured to mount in a stock of the firearm and receive a rear action screw therethrough to secure an action of the firearm to the rear action pillar. The firearm further includes a front action screw pillar configured to mount in the stock of the firearm forward of the rear action screw pillar and receive a front action screw therethrough to secure the action of the firearm to the front action screw pillar.

In another aspect, a firearm includes a stock having a rear recess and a front recess forward of the rear recess. The firearm further includes a rear action screw pillar configured to mount in the rear recess of the stock and receive a rear action screw therethrough to secure an action of the firearm to the rear action pillar, and a front action screw pillar configured to mount in the front recess of the stock forward of the rear action screw pillar and receive a front action screw therethrough to secure the action of the firearm to the front action screw pillar.

In another aspect, a bedding block system configured to mount an action to a stock of a firearm includes rear action screw pillar. The rear action screw pillar is configured to mate in the stock when the firearm is assembled. The rear action screw pillar includes a contoured top wall configured to be complimentary to and receive the action, a bottom wall opposite the top wall configured to mate with a bottom plate of the firearm, and a rear screw hole configured to receive a rear action screw therethrough to secure the action onto the rear action screw pillar. The bedding block system also includes a front action screw pillar configured to mate in the stock when the firearm is assembled. The front action screw pillar includes a contoured top wall configured to be complimentary to and receive the action thereon, a bottom wall opposite the top wall configured to mate with the bottom plate, a front wall, a rear wall opposite the front wall, and a pair of lateral sides extending between the front wall and the rear wall. Each lateral side includes a groove therein extending from the top wall to the bottom wall, and each groove defining a lateral locking feature configured to a complimentary protrusion of the stock. The front action screw pillar further includes a front locking tab extending outwardly from the front wall and configured to mate with the stock and a front screw hole configured to receive a front action screw therethrough to secure the action to the front action screw pillar.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
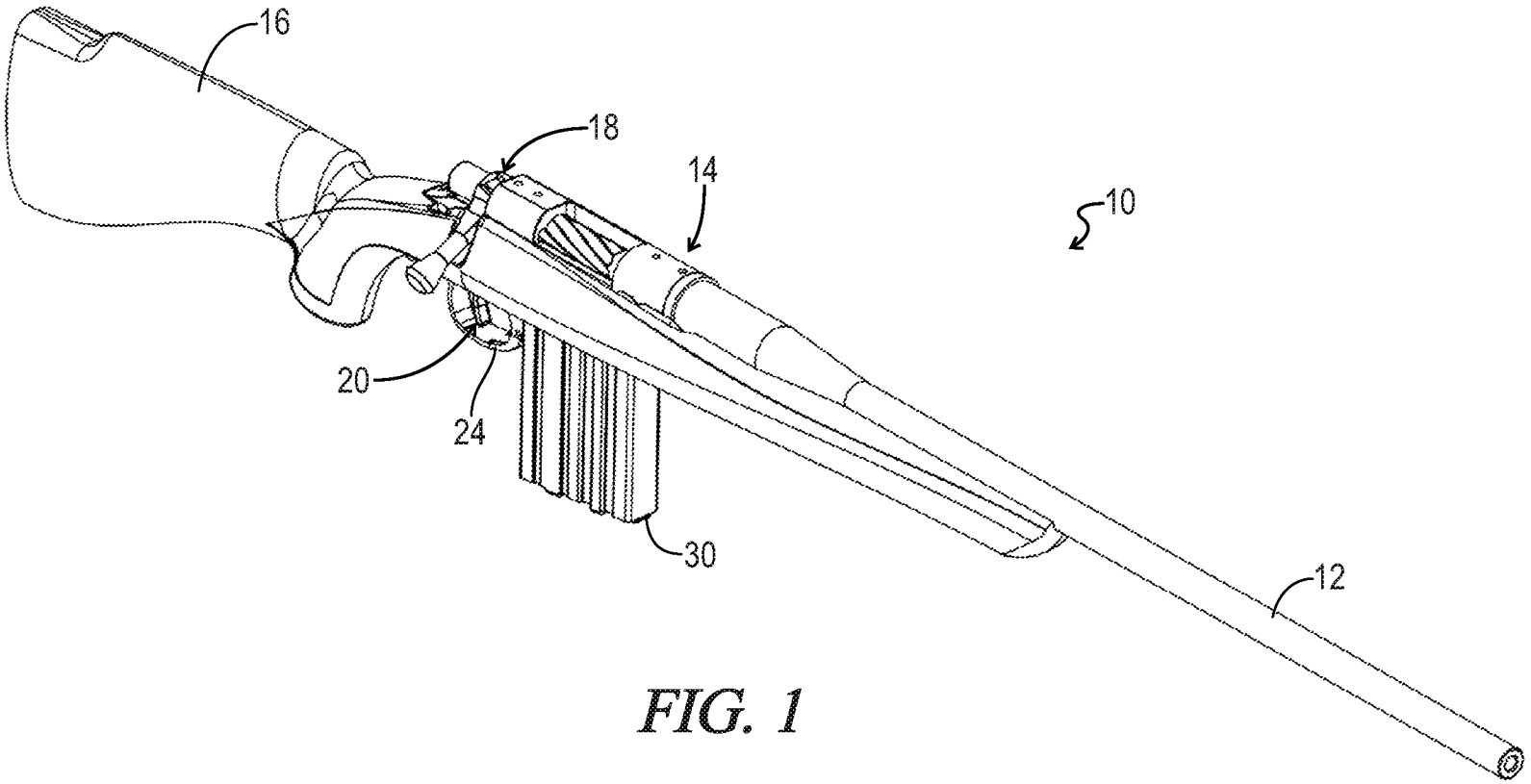
FIG. 1 is an elevated right side perspective view of a firearm including a stock and a bedding system, according to an exemplary embodiment.

While the making and using of various embodiments of the invention are discussed in detail below, it should be appreciated that the disclosure provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of a stock, firearm, or bedding block, is when fully assembled as a firearm and held in position to shoot generally level by a user. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical or mechanical connection between the connected items or an indirect connection through one or more passive or active intermediary devices.

As used herein, a stock or chassis is a system configured to receive a firearm action and support the action for use by a shooter. The stock may be a buttstock, a pistol stock, a chassis, a micro-chassis, or any other device configured to support a firearm action during firing of the action. In these systems, the firearm action is generally a rifle action, but may also be a shorter pistol action, shotgun action, or other action for a firearm.

Figure 2:
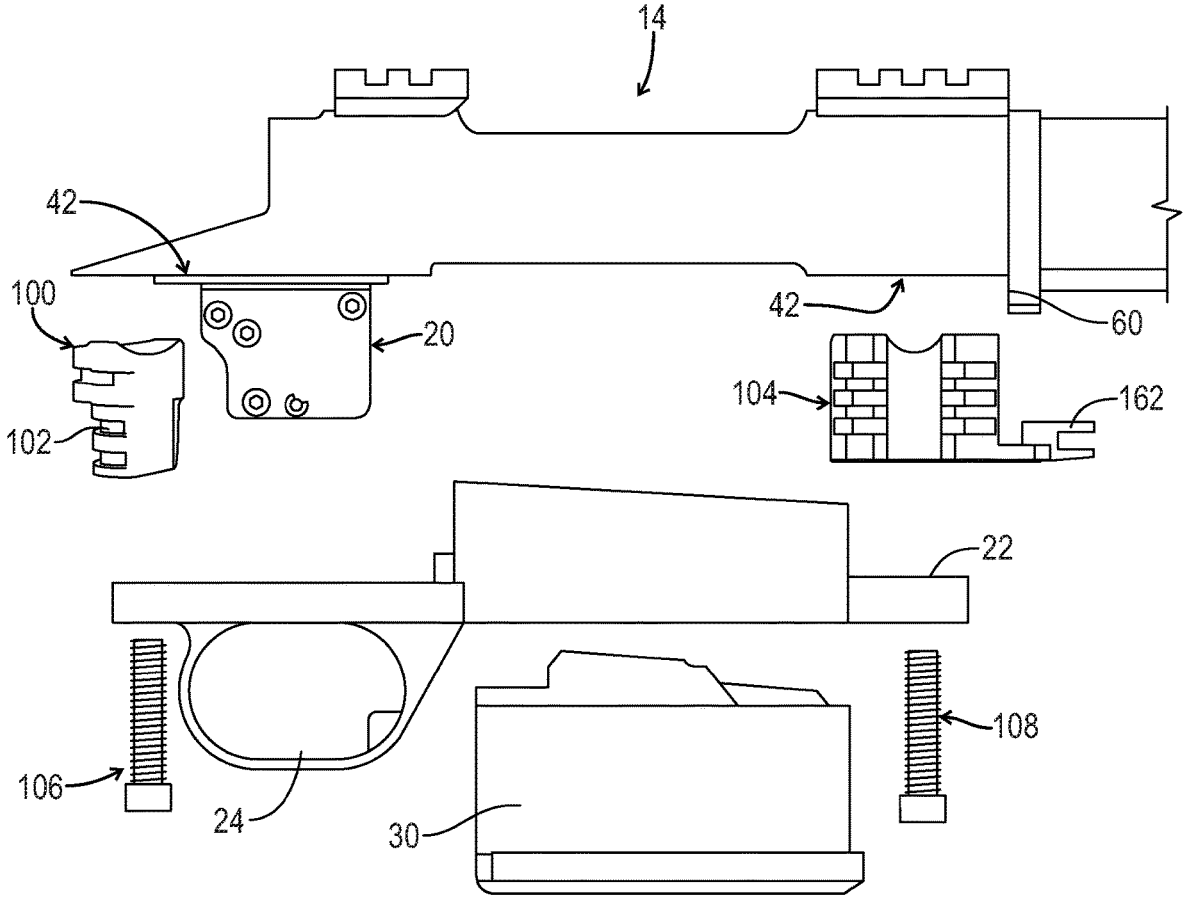
FIG. 2 is an exploded view of the bedding system of FIG. 1.
Figure 3:
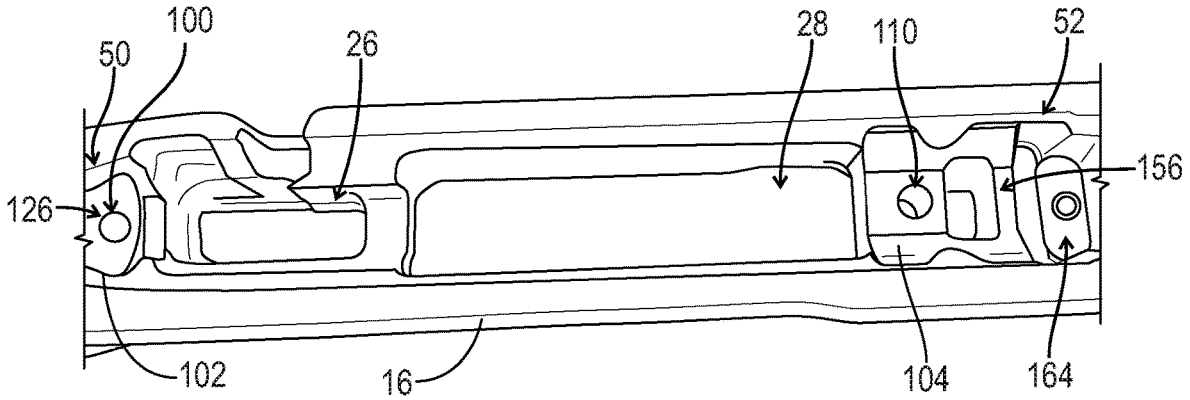
FIG. 3 is a top view of view of the bedding system assembled into the stock of the firearm of FIG. 1.

Referring to FIGS. 1-3, in one embodiment, a firearm 10 generally includes a barrel 12, an action 14 connected to the barrel 12 (forming a barreled action), a stock 16, a bolt assembly 18, a trigger assembly 20, a bottom plate 22 forming a trigger guard 24, magazine well 26, 28 (extending through the plate 22 and stock 16), and a magazine 30. The firearm 10 further includes a bedding system 100 configured to mount and secure the action 14 onto the stock 16 when the firearm 10 is assembled (as shown in FIG. 1). The bedding system 100 is configured to reduce the overall weight of the firearm 10, without decreasing the accuracy and precision of the firearm 10. The bedding system 100 provides a strong lightweight bedding system 100 that a shooter, or end consumer, can use to install an action 14 into the stock 16, without the need for a prior art bedding block (which would otherwise undesirably increase the overall weight of the firearm).

In one embodiment, the bedding system 100 comprises a two-part bedding block that includes separate rear and front action screw pillars 102, 104. When the firearm 10 is assembled, rear and front action screws 106, 108 respectively extend through screw holes 40 in the bottom plate 22, through screw holes 110 in the action screw pillars 102, 104, and thread into screw holes 42 at a bottom of the action 14 (FIG. 2), securing the action 14 onto the stock 16. The rear and front action screw pillars 102, 104 are configured to mount in respective rear and front recesses 50, 52 of the stock 16. Each action screw pillar 102, 104 can be bedded into the stock 16 via epoxy such that each screw pillar 102, 104 is fitted and fully housed within the stock 16. In one embodiment, each action screw pillar 102, 104 is mounted to the stock 16 via epoxy. Each rear and front action screw pillar 102, 104 has integrated locking features that mate with complimentary features of the stock 16 to secure the two-part bedding block 100, creating a lightweight and secure connection between the barreled action and the stock 16. In one embodiment, the two-part bedding block 100 can be formed of aluminum and weigh 2 ounces, saving approximately 4 ounces over known lightweight bedding blocks (e.g., single piece bedding blocks). As discussed in more detail below, the outside dimension or perimeter of each action screw pillar 102, 104 may help to self-lock each action screw pillar 102, 104 in the stock 16, and gaps are then filled during bedding with epoxy or another suitable bedding material.

Figure 4:
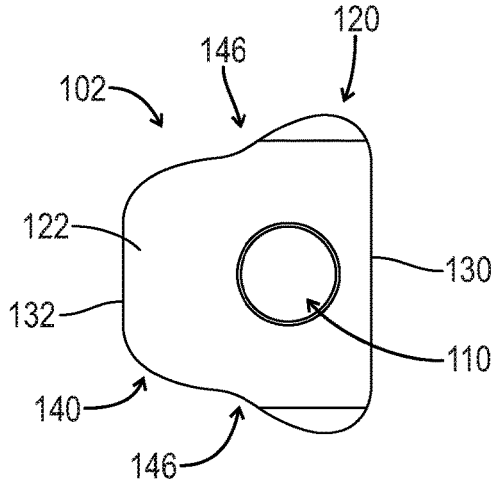
FIG. 4 is a top plan view of a rear action screw pillar of the bedding system in isolation.
Figure 5:
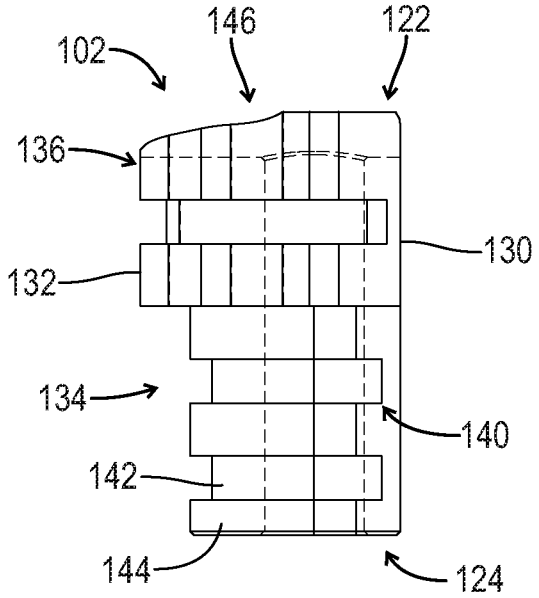
FIG. 5 is a side view of the rear action screw pillar of FIG. 4.
Figure 6:
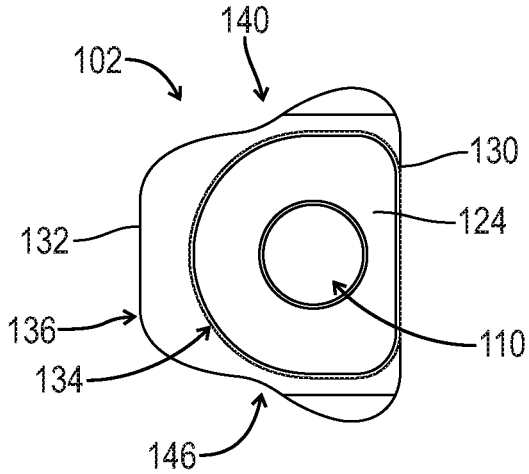
FIG. 6 is a bottom view of the rear action screw pillar of FIG. 4.

Referring to FIGS. 4-6, there is shown an exemplary embodiment of a rear action screw pillar 102 that is complementary in shape and size to the rear recess 50 of the stock 16. A top of the rear action screw pillar 102 defines an action contact surface. The rear action screw pillar 102 sets the correct height based on action type, along with the outer machined surface area that locks into the stock 16. The top surface of the rear action screw pillar 102 is contoured to fit to the action 14 (i.e., is specific to a particular rifle action type or clone, as discussed below in more detail).

The rear action screw pillar 102 includes a body 120 with a screw hole extending through the body 120. The body 120 of the rear action screw pillar 102 also includes a contoured top wall 122 that is complimentary to and receives the bottom of the action 14 thereon and a bottom wall 124 opposite the top wall 122 that is configured to mate with the top of the plate 22. In other words, an upper surface 122 of the rear action screw pillar 102 is generally complementary to a rear surface of the action 14 about a rear action screw hole 42 of the action 14. The top wall 122 may taper downwardly as the top wall 122 extends from the front to the rear thereof. The top wall 122 of the body 120 can have a concaved or arcuate profile defining a valley or a trough 126 that receives the action 14. The top wall 122 can have a first, rear section and a second, front section that is wider than the first section and which has upwardly biased wings or lips that define the valley 126. In one embodiment, the concaved profile of the top wall 122 has a radius of curvature which is greater than a radius of curvature of the corresponding section of the action 14, and in another embodiment, the radius of curvature is equal to the radius of curvature of the corresponding section of the action 14. The screw hole 110 can extend through the body 120 from the bottom wall 124 to the top wall 122.

The body 120 further includes a front wall 130 that is substantially flat and which may sit approximately flush with the trigger assembly 20 next to the trigger well 26, and a rear wall 132 opposite the front wall 130. In one embodiment, the body 120 has a lower section 134 (which contacts the plate 22) and an upper section 136 (which contacts the action 14) that is larger and overhangs or defines a ledge above the lower section 134. Hence, the rear wall 132 can be tiered such that a top section of the rear wall 132 overhangs above a lower section of the rear wall 132. The lower and upper sections 134, 136 can have differing shapes and sizes. In one embodiment, the upper section 136 can define a trapezoidal body that overhangs above the lower section 134 (except that the front wall 130, at which the lower and upper sections 134, 136 are substantially flush with one another). The lower section 134 can define an ellipsoidal or arched body with a flat or truncated section at the front end thereof, such that the lower and upper sections 134, 136 are flush with one another at the front wall 130 of the body 120.

The body 120 of the rear action screw pillar 102 further includes a pair of lateral sides 140 extending between the front wall 130 and the rear wall 132. Each lateral side 140 can be ribbed, e.g., horizontal grooves 142 and protrusions 144, to provide increased surface area of the lateral sides 140 for epoxy to join the body 120 of the rear action screw pillar 102 to the stock 16, when the rear action screw pillar 102 is mounted in the stock 16. In one embodiment, the ribs 142, 144 can extend continuously around the lateral sides 140 and the rear wall 132 of rear action screw pillar 102. In one embodiment, each lateral side 140 on the upper section 136 of the body 120 can have a vertical groove or indent 146, forming a concaved section 146 in between rear and front planar sections of each lateral side 140 on the upper section 136 of the body 120. The concaved section 146 of each lateral side 140 can define a lateral locking feature 146 that mates with a corresponding protrusion of the stock 16, respectively, for further securing the rear action screw pillar 102 within the rear recess of the stock 16.

Figure 7:
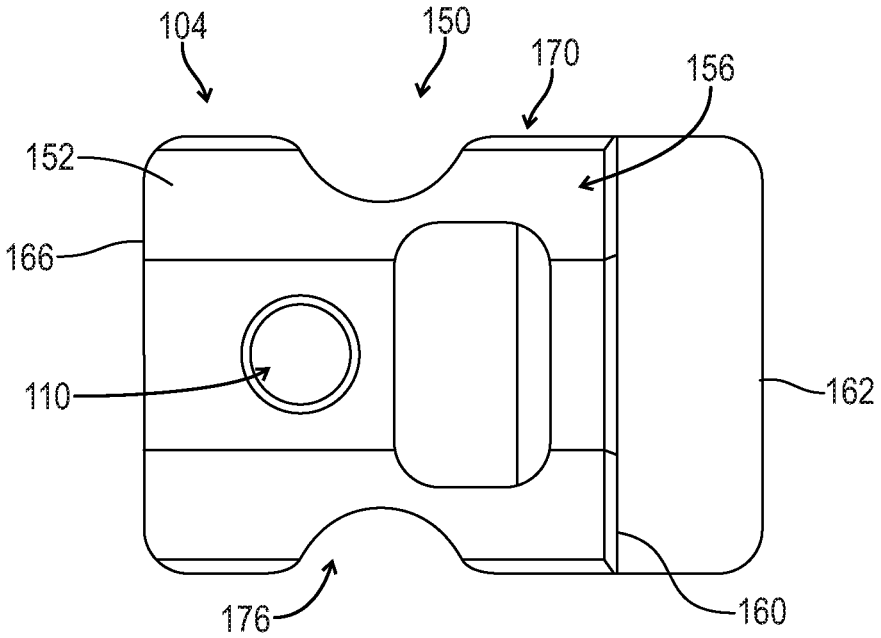
FIG. 7 is a top plan view of a front action screw pillar of the bedding system in isolation.
Figure 8:
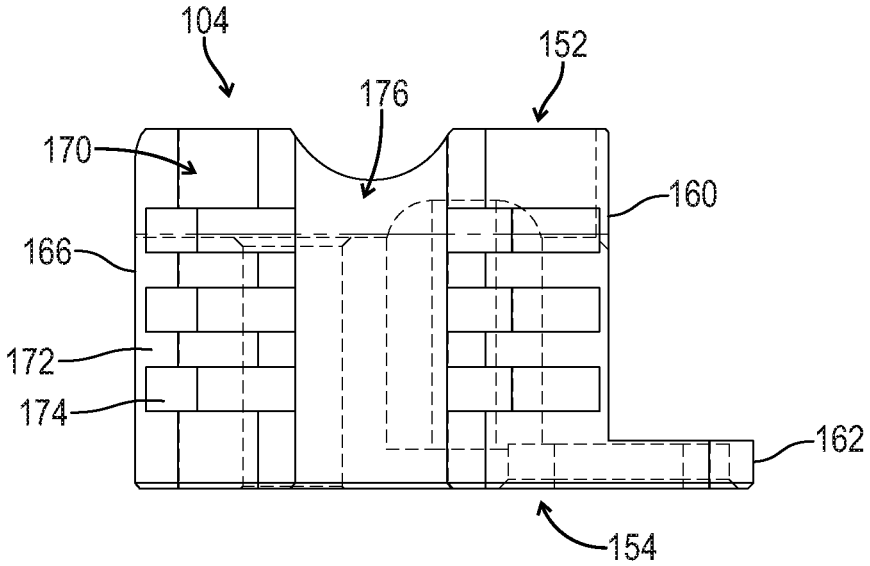
FIG. 8 is a side view of the rear action screw pillar of FIG. 4.
Figure 9:
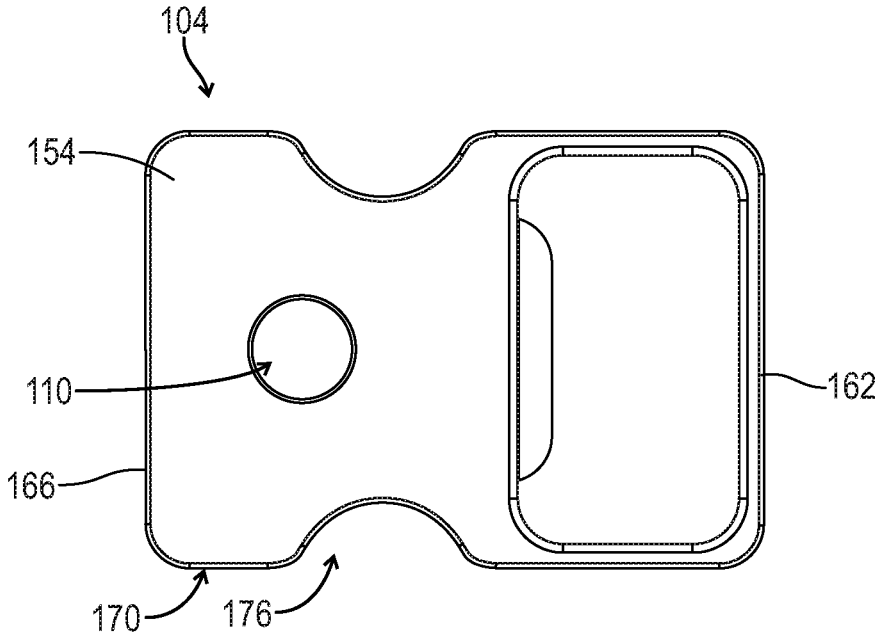
FIG. 9 is a bottom view of the rear action screw pillar of FIG. 4.

Referring to FIGS. 7-9, there is shown an exemplary embodiment of a front action screw pillar 104 that is complimentary in shape and size to the front recess of the stock 16. When assembled, the front action screw pillar 104 is disposed forward of the rear action screw pillar 102. The front action screw pillar 104 can include one or more action bedding contact surfaces that touch the action 14 in at least one location (e.g., three locations). In one embodiment, the first contact point is the recoil lug contact area configured to contact the recoil lug of the barreled action 14, as discussed below. The second and third contact points are along the sides of the action 14 at about the 4 o'clock and 8 o'clock positions, rearward of the recoil lug area toward the magazine well 28. These contact points ensure that the bottom of the action 14 at the 6 o'clock position is not touching the micro chassis (e.g., stock, buttstock, or chassis) such that the barrel is full floating.

The front action screw pillar 104 includes a body 150 with a screw hole 100 extending through the body 150. In one embodiment, the body 150 further includes a contoured top wall 152 that is complimentary to and receives the bottom of the action 14 thereon and a bottom wall 154 opposite the top wall 152 that is configured to mate with the top of the plate 22. The top wall 152 of the body 150 can have a rear section with a channel or longitudinal cutout and upwardly biased wings or lips, a middle section with a middle cutout (through which screw hole extends), and a front section with upwardly biased wings or lips, defining a concaved valley or receiving space 156 for receiving the bottom of the action 14. In one embodiment, the concaved profile of the top wall 152 can have a radius of curvature which is greater than a radius of curvature of the corresponding section of the action 14. In another embodiment, the top wall 152 (i.e., wings of the top wall) are flat, but angled and spaced apart such that the bottom of the action about the front action screw hole does not contact the front action screw pillar 104.

In one embodiment, the front action screw pillar 104 comprises a valley 156 such that the front action screw pillar 104 is configured to contact the action 14 at between 45 and 75 degrees from the bottom of the action 14 relative to the longitudinal axis when the firearm 10 is assembled. In one embodiment, the bottom of the action 14 does not contact the front action screw pillar 104 within 30 degrees of the front action screw hole 42 relative to the longitudinal axis when the firearm 10 is assembled.

The body 150 of the front action screw pillar 104 further includes a front wall 160 that is substantially flat or planar and a front locking tab or shelf 162 extending outwardly and forwardly of the front wall 160. The front locking tab 162 can be configured to mate with a corresponding portion of the front recess of the stock 16. The locking tab 162 serves to space the front wall 160 away from a rear-facing wall of the front recess 52 of the stock 16, forming a lug gap 164 in between the front wall 160 and the juxtaposed rear-facing wall of the recess 52 of the stock 16 such that the downwardly extending lug 60 (or protrusion) is receivable within the lug gap 164. Thereby, the front wall 160 of the body 150 may define a locking feature 160 in the form of a lug mechanical stop (or recoil lug contact surface) that is configured to contact the lug 60 of the action 14 and prevent linear rearward movement thereof. In one embodiment, the locking tab 162 may be flush with and/or define a portion of the bottom wall 154 of the body 150. The front locking tab 162 defines the terminal front end of the front action screw pillar 104.

The body 150 of the front action screw pillar 104 further includes a rear, planar wall 166 opposite the front wall 160. The rear wall 166 may rest next to or flush with the magazine well 28 of the plate. The body 150 further includes a pair of lateral sides 170 extending between the front wall 160 and the rear wall 166. Each lateral side 170 can be ribbed, e.g., horizontal grooves 172 and protrusions 174, to provide increased surface area of the lateral sides 170 for epoxy to join the front action screw pillar 104 to the stock 16, when the front action screw pillar 104 is mounted in the stock 16. In one embodiment, each lateral side 170 can include a vertical groove 176 therein extending from the top wall 152 to the bottom wall 154. Each groove 176 can define a lateral locking feature 176 configured to receive a complimentary protrusion of the stock 16, preventing longitudinal and rotational movement of the front action screw pillar 104.

In one embodiment, the locking features of the rear and front action screw pillars 102, 104 prevent movement of the action 14 relative to the longitudinal axis. The locking features of the rear action screw pillar 102 can be defined by the ledge (i.e., lowermost protrusion 144) of the upper section 136, the vertical concave section 146 at the upper section 136, and the horizontal grooves 142 (defining the ribs). The locking features of the front action screw pillar 104 can be defined by the front wall itself 160, the front locking tab 162, the vertical lateral side grooves 176, and the horizonal grooves 172 (defining the ribs). The locking features collectively help to lock the rear and front action screw pillars 102, 104 within the stock 16 when the front and rear action screw pillars 102, 104 are mounted or bedded into the stock 16 and immobilize the action 14 relative to the stock 16 when shooting the firearm 10, thereby increasing the durability and accuracy of the firearm 10.

In one embedment, the bedding system 100 can be tailored to a particular firearm or action, such as a Remington® 700 series bolt-action or clone thereof. For example, the rear action screw pillar 102 can have a form fit contour at its top surface that is complimentary to the bottom surface of a Remington® 700 type action. Also, the front action screw pillar 104 can have form fit contour at its top surface and define a recoil lug area at its front wall that can receive a bottom surface and a lug 60 extending from the bottom of a Remington® 700 type action, respectively. Thereby, the bedding system 100 may be configured to secure any desired short, medium, or long action that is a Remington 700 clone. In one embodiment, the stock is a composite material (e.g., plastics, fiberglass, or carbon fiber) and the front and rear action pillars are steel.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of a new and useful TWO PART BEDDING BLOCK FOR A FIREARM it is not intended that such references be construed as limitations upon the scope of the invention except as set forth in the following claims.

What is claimed is:

1. A firearm comprising:

a rear action screw pillar configured to mount in a stock of the firearm and receive a rear action screw therethrough to secure an action of the firearm to the rear action pillar; and a front action screw pillar configured to mount in the stock of the firearm forward of the rear action screw pillar and receive a front action screw therethrough to secure the action of the firearm to the front action screw pillar, said front action screw pillar comprising a groove in a lateral side wall of the front action screw pillar, said groove extending from and into a top wall of the front action screw pillar toward a bottom wall of the front action screw pillar.

2. The firearm of claim 1, wherein:

the rear action screw pillar is mounted to the stock by bedding the rear action screw pillar into the stock; and the front action screw pillar is mounted to the stock by bedding the front action screw pillar into the stock.

3. The firearm of claim 1, wherein:

the rear action screw pillar is mounted to the stock via epoxy; and the front action screw pillar is mounted to the stock via epoxy.

4. The firearm of claim 1, wherein:

the action is configured to extend along a longitudinal axis when the firearm is assembled; and the front action screw pillar comprises a valley such that the front action screw pillar is configured to contact the action at between 45 and 75 degrees from a bottom of the action relative to the longitudinal axis when the firearm is assembled.

5. The firearm of claim 1, wherein:

the action is configured to extend along a longitudinal axis when the firearm is assembled;

the front action screw pillar comprises a valley such that the front action screw pillar is configured to contact the action at between 45 and 75 degrees from a bottom of the action relative to the longitudinal axis when the firearm is assembled; and the bottom of the action has a front action screw hole configured to receive a front action screw when the firearm is assembled.

6. The firearm of claim 1, wherein:

an upper surface of the rear action screw pillar is complementary to a rear surface of the action about a rear action screw hole of the action; and the rear action screw hole of the action is configured to receive the rear action screw to secure the action to the rear action screw pillar when the firearm is assembled.

7. The firearm of claim 1, wherein:

the front action screw pillar is wider at a front and a rear of the front action screw pillar than at a middle of the front action screw pillar such that the front action screw pillar mechanically interlocks longitudinally in the stock when the front action screw pillar is mounted in the stock.

8. The firearm of claim 1, wherein:

lateral sides of the front action screw pillar are ribbed to provide increased surface area of the lateral sides of the front action screw for epoxy to join the front action screw to the stock when the front action screw pillar is mounted in the stock.

9. The firearm of claim 1, wherein:

lateral sides of the rear action screw pillar are ribbed to provide increased surface area of the lateral sides of the rear action screw for epoxy to join the rear action screw to the stock when the rear action screw pillar is mounted in the stock.

10. The firearm of claim 1, wherein:

the front action screw pillar comprises a front wall and a front locking tab extending outwardly from the front wall;

the locking tab of the front action screw pillar is configured to mate with the stock; and the front wall of the front action screw pillar defining a recoil lug mechanical stop configured to contact a lug of the action.

11. The firearm of claim 1, wherein:

the firearm further comprises the stock;

the stock comprises a rear recess configured to receive the rear action screw pillar; and the stock comprises a front recess configured to receive the front action screw pillar.

12. The firearm of claim 1, further comprising:

the stock;

the front action screw;

the rear action screw; and the action, wherein the action comprises a barrel affixed thereto.

13. A firearm comprising:

a stock having a rear recess and a front recess forward of the rear recess;

a rear action screw pillar configured to mount in the rear recess of the stock and receive a rear action screw therethrough to secure an action of the firearm to the rear action pillar; and a front action screw pillar configured to mount in the front recess of the stock forward of the rear action screw pillar and receive a front action screw therethrough to secure the action of the firearm to the front action screw pillar, said front action screw pillar comprising a groove in a lateral side wall of the front action screw pillar, said groove extending from and into a top wall of the front action screw pillar toward a bottom wall of the front action screw pillar.

14. The firearm of claim 13, wherein:

the rear action screw pillar is mounted to the stock by bedding the rear action screw pillar into the stock; and the front action screw pillar is mounted to the stock by bedding the front action screw pillar into the stock.

15. The firearm of claim 13, wherein:

the rear action screw pillar is mounted to the stock via epoxy; and the front action screw pillar is mounted to the stock via epoxy.

16. The firearm of claim 13, wherein:

an upper surface of the rear action screw pillar is complementary to a rear surface of the action about a rear action screw hole of the action; and the rear action screw hole of the action is configured to receive the rear action screw to secure the action to the rear action screw pillar when the firearm is assembled.

17. The firearm of claim 13, wherein:

the front action screw pillar is wider at a front and a rear of the front action screw pillar than at a middle of the front action screw pillar such that the front action screw pillar mechanically interlocks longitudinally in the stock when the front action screw pillar is mounted in the stock.

18. The firearm of claim 13, wherein:

lateral sides of the front action screw pillar are ribbed to provide increased surface area of the lateral sides of the front action screw for epoxy to join the front action screw to the stock when the front action screw pillar is mounted in the stock.

19. The firearm of claim 13, wherein:

lateral sides of the rear action screw pillar are ribbed to provide increased surface area of the lateral sides of the rear action screw for epoxy to join the rear action screw to the stock when the rear action screw pillar is mounted in the stock.

20. A bedding block system configured to mount an action to a stock of a firearm, the bedding block system comprising:

a rear action screw pillar configured to mate in the stock when the firearm is assembled, comprising:

a contoured top wall configured to be complimentary to and receive the action;

a bottom wall opposite the top wall configured to mate with a bottom plate of the firearm; and a rear screw hole configured to receive a rear action screw therethrough to secure the action onto the rear action screw pillar; and a front action screw pillar configured to mate in the stock when the firearm is assembled, comprising:

a contoured top wall configured to be complimentary to and receive the action thereon;

a bottom wall opposite the top wall configured to mate with the bottom plate;

a front wall;

a rear wall opposite the front wall;

a pair of lateral sides extending between the front wall and the rear wall, each lateral side comprising a groove therein extending from the top wall to the bottom wall, each groove defining a lateral locking feature configured to a complimentary protrusion of the stock;

a front locking tab extending outwardly from the front wall and configured to mate with the stock; and a front screw hole configured to receive a front action screw therethrough to secure the action to the front action screw pillar.

* * * * *